United States Patent [19]

Kashio

[11] 3,992,875

[45] *Nov. 23, 1976

[54] ELECTRONIC CLOCK APPARATUS

[75] Inventor: Toshio Kashio, Tokyo, Japan

[73] Assignee: Casio Computer Co., Ltd., Tokyo, Japan

[ * ] Notice: The portion of the term of this patent subsequent to Nov. 18, 1992, has been disclaimed.

[22] Filed: Sept. 2, 1975

[21] Appl. No.: 609,511

Related U.S. Application Data

[63] Continuation-in-part of Ser. No. 450,441, March 12, 1974, Pat. No. 3,919,835.

[30] Foreign Application Priority Data

Mar. 15, 1973 Japan ..... 48-30412

[52] U.S. Cl. ..... 58/50 R; 58/23 R; 58/127 R

[51] Int. Cl.[2] ..... G04B 19/30

[58] Field of Search ..... 58/23 R, 50 R, 127 R, 58/85.5

[56] References Cited

UNITED STATES PATENTS

| | | | |
|---|---|---|---|
| 3,630,015 | 12/1971 | Lehovec | 58/50 R |
| 3,707,071 | 12/1972 | Walton | 58/23 A |
| 3,754,392 | 8/1973 | Daniels | 58/50 R |
| 3,760,406 | 9/1973 | Walton | 58/50 R |
| 3,765,163 | 10/1973 | Levine et al. | 58/50 R |
| 3,919,835 | 11/1975 | Kashio | 58/50 R |

*Primary Examiner*—Ulysses Weldon
*Attorney, Agent, or Firm*—Flynn and Frishauf

[57] ABSTRACT

Six groups of time indicating elements are constituted by combining 10 "minute" indicating elements with two of 12 "hour" indicating elements. One terminal of the time indicating elements in the respective group is commonly connected to a first connecting means and the opposite terminal of the corresponding time indicating elements in the respective group is commonly connected to a second connecting means. Hour and minute indicating signals from a time counting device of an electronic clock apparatus are supplied, in a time division fashion, through the first and second connecting means to the corresponding time indicating element.

3 Claims, 7 Drawing Figures

ELECTRONIC CLOCK APPARATUS

CROSS-REFERENCE TO THE RELATED APPLICATION

This patent application is a continuation-in-part of my patent application Ser. No. 450,441 filed Mar. 12, 1974 now U.S. Pat. No. 3,919,835 issued on Nov. 18, 1975.

BACKGROUND OF THE INVENTION

This invention relates to an electronic clock apparatus for effecting a time display by supplying outputs of a time counting device selectively to a plurality of optical time indicating elements.

The time indication of a conventional clock is effected by an hour indicating short hand and minute indicating long hand. In contrast, there has been developed an electronic clock apparatus of the type in which optical time indicating elements such as light emitting diodes, liquid crystal elements, etc. are selectively displayed by output signals from a time counting device. For example, 12 light emitting diodes are arranged in a closed loop on a time display panel to constitute an hour indicating section and, outside of the hour indicating section, 60 light emitting diodes are arranged in a closed loop to form a minute indicating section. An hour indicating signal from the time counting device is applied selectively to the 12 light emitting diodes to provide an hour indication and, at the same time, a minute indicating signal is applied selectively to the 60 light emitting diodes to provide a minute indication.

With the so constructed clock apparatus, at least 72 circuit lines are required to selectively supply 72 kinds of time indicating signals in a variety of combinations from the time counting device to the 72 individual display elements so that time can be displayed on the time display panel. For example, where the time counting device is embodied in an IC form, difficulty is presented in making an electrical connection between a highly integrated circuit and each display element. This provides a barrier to the miniaturization of the time counting device per se. Furthermore, where the time counting device is provided separately from the time display elements, the corresponding connection line is lengthened. This provides a cause for trouble and, in addition, added cost is involved.

SUMMARY OF THE INVENTION

It is accordingly the object of this invention to provide an electronic clock apparatus capable of providing for the miniaturization of a time counting device and reduction of costs by making an electrical connection between the time counting device and a plurality of display elements using a lesser number of circuit lines.

The object of this invention can be attained by an electronic clock apparatus comprising a time counting device, a plurality of hour indicating elements arranged in a closed loop so as to be responsive to an hour signal from the time counting device; a plurality of groups of indicating elements for indicating both minutes and seconds, each group being associated with the respective hour indicating element so as to be responsive to a minute signal and a second signal from the time counting device, a respective group of minute and second indicating elements together with at least 1 hour indicating element constituting a set of time indicating elements; a first connecting means connected in common to one electrode of the time indicating elements included in a respective set; a second connecting means connected in common to another electrode of the corresponding time indicating elements each present in the respective sets; and a time division control means for supplying in a time division fashion the hour, and second signals from the time counting device to the corresponding time indicating elements via said connecting means.

DETAILED DESCRIPTION OF THE PREFERRED EMBODIMENTS

Figure 1:
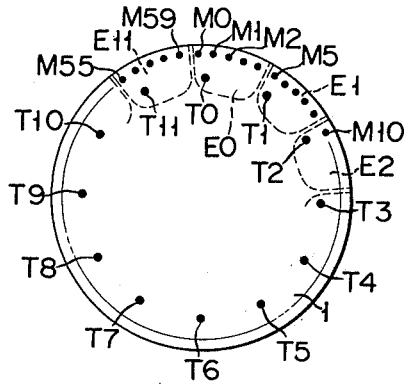
FIG. 1 is a plan view showing the time display section of a clock apparatus according to one embodiment of this invention.

In FIG. 1, 60 light emitting diodes M0, M1, . . . M59 for minute indication are equidistantly arranged in a closed loop fashion along the peripheral edge of a disc-like time indicating panel 1 of an electronic clock apparatus. Within the closed loop of the light emitting diodes M0, M1, . . . M59, additional light emitting diodes T0, T1, . . . T11 for hour indication are equidistantly arranged in a closed loop fashion. The light emitting area of the light emitting diodes T0, T1, . . . T11 can be made larger than that of the light emitting diodes M0, M1, . . . M59, as shown in the Figure. The diode T0 indicates 0 or 12 o'clock; the diode T1, 1 o'clock; the diode T2, 2 o'clock; . . . T11, 11 o'clock, while the diode M0 indicates 0 minute; the diode M1, 1 minute; the diode M2, 2 minutes; . . . the diode M59, 59 minutes. For example, if the diodes T0, T1, . . . T11 are arranged on the time indicating panel 1 so as to align with the diodes M0, M5, M10, . . . M55, respectively, time can be read out as in the conventional clock. Twelve electrode plates E0, E1, . . . E11 are disposed on the time display panel 1 so as to correspond to the hour indicating diodes T0, T1, . . . T11, respectively. The respective cathode of the hour indicating diode T0 and minute indicating diodes M0–M4 is connected directly to the electrode plate E0; and the respective cathode of the hour indicating diode T1 and minute indicating diodes M5–M9, to the electrode plate E1; and so on.

Figure 2A:
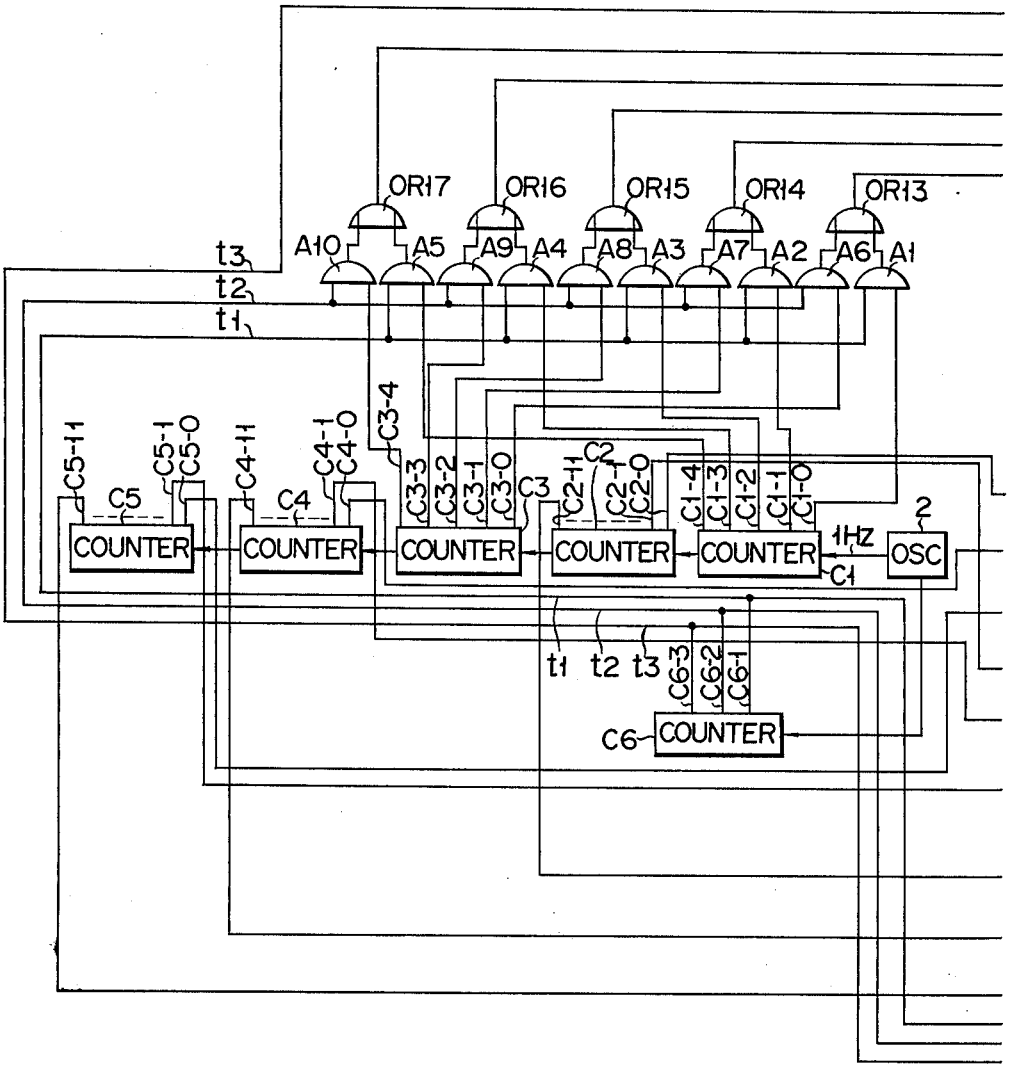
FIGS. 2A and 2B show a schematic circuit diagram of the embodiment of FIG. 1.
Figure 2B:
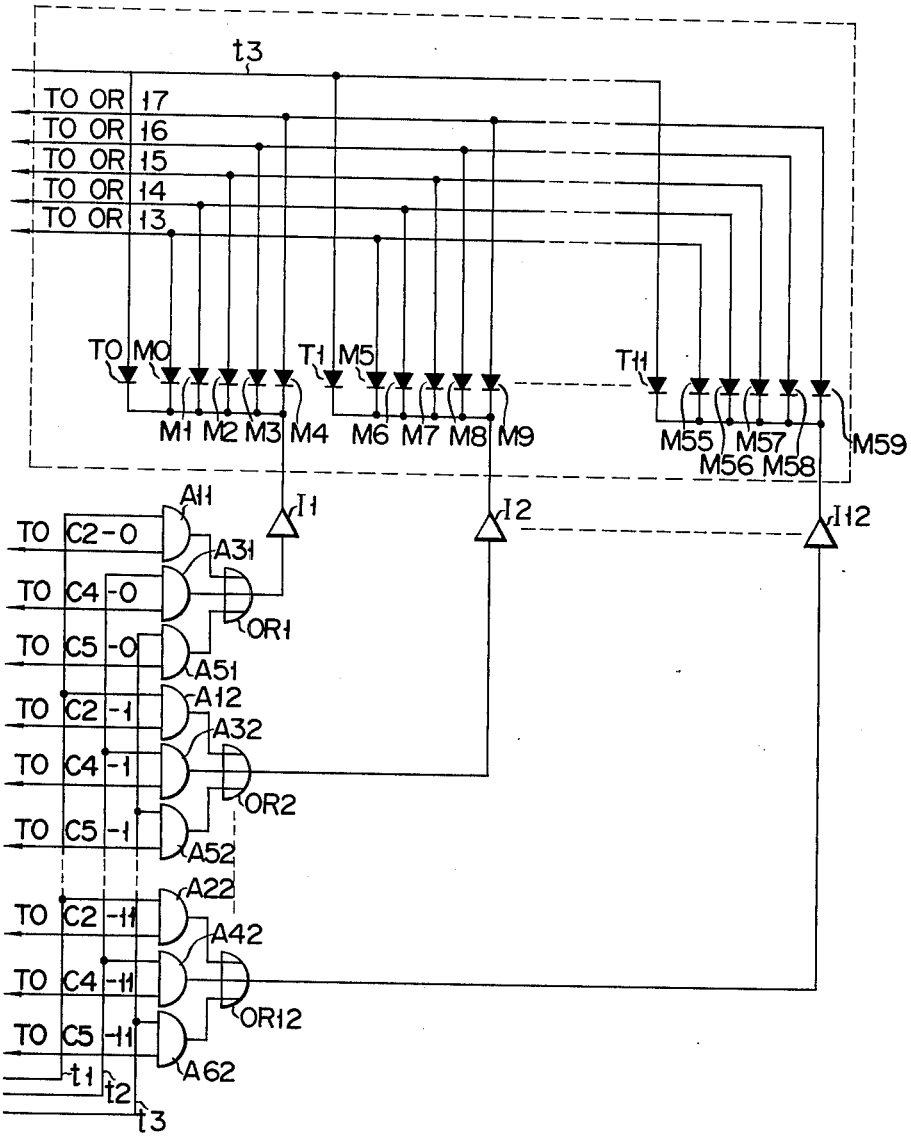

In FIGS. 2A and 2B, the cathodes of the six diodes T0 and M0–M4 are connected through the electrode plate E0 shown in FIG. 1 to the output terminal of an inverter I1, and six diodes T1 and M5–M9 are connected through the electrode plate E1 to the output terminal of an inverter I2. Likewise, the other diodes T2–T11 and M10–M59 are connected through the respective electrode plates E2–E11 to the respective output terminal of inverters I3–I12. The respective input terminals of the inverters I1–I12 are connected to the output terminals of 12 OR gates OR1–OR12, respectively. The output $t3$ of a counter C6 is fed in common to the anode of the hour indicating diodes T0–T11. The output of the OR gate OR13 is fed in common to the anode of the minute indicating diodes M0, M5, M10, . . . M55. Likewise, the outputs of the OR gates OR14–OR17 are fed in common to the anodes of the diodes (M1, M6, . . . M56), (M2, M7, . . . M57), (M3, M8, . . . M58) and (M4, M9, . . . M59), respectively. The outputs of AND gates A1 and A6 are connected to the inputs of the OR gate OR13, the outputs of AND gates A2 and A7, the inputs of the OR gate OR14; the outputs of AND gates A3 and A8, the inputs of the OR gate OR15; the outputs of AND gates A4 and A9, the inputs of the OR gate OR16; and the outputs of AND gates A5 and A10, the inputs of the OR gate OR17. The output $t1$ of the counter C6 is coupled to one input terminal of the AND gates A1 to A5 and the output $t2$ of the counter C6 is coupled to one input terminal of the AND gates A6 to A10. The output $t1$ of the counter C6 is also connected in common to one input terminal of 12 AND gates A11, A12, . . . A22 and the output $t2$ of the counter C6 is connected in common to one input terminal of 12 AND gates 31–42. The output $t3$ is connected in common to one input terminal of 12 AND gates A51–A62. The outputs of the AND gates A11, A31 and A51 are connected to the inputs of the OR gate OR1; and the outputs of the AND gates A12, A32 and A52, the inputs of the OR gate OR2. Likewise, the outputs of the AND gates A13 to A22, A33 to A42 and A53 to A62 are connected to the inputs of OR gates OR3 to OR12, respectively.

The counter C6 is, for example, a scale of 3 counter consisting of three flip-flop circuits and is adapted to count the number of output pulses from a pulse oscillating circuit 2. When, in the case of a light emitting diode, the frequency fed from the pulse oscillating circuit 2 to the counter C6 is set, for example, to about 1 KHz, three outputs $t1$, $t2$ and $t3$ of equal interval are sequentially supplied, according to an input pulse interval (about 1m sec), from the three flip-flop circuits which constitute the counter C6.

A time counting device used in the electronic clock apparatus will now be described below.

Aside from the 1 KHz frequency pulse supplied to the counter C6, a pulse with a 1-second interval is supplied from the pulse oscillating circuit 2. The pulse oscillating circuit 2 can be easily obtained, for example, by a combination of a high-frequency oscillator and a plurality of frequency dividing circuits adapted to divide the oscillation frequency of the high-frequency oscillator to form pulses having equal intervals of 1 second and 1m second.

A pulse signal with a 1-second interval is supplied from the pulse oscillating circuit 2 to the input of a scale of 5 counter C1. A carry signal fed from the scale of 5 counter C1 at 5-second intervals is supplied to a scale of 12 counter C2. A scale of 60 counter circuit is formed by so combining the scale of 5 counter C1 and scale of 12 counter C2. A carry signal is delivered at 1-minute intervals from the counter C2. Five count value output terminals C1-0, C1-1, C1-2, C1-3 and C1-4 are provided on the counter C1. From the output terminals C1-0, C1-1, C1-2, C1-3 and C1-4, outputs having an interval of 1 second are sequentially delivered in its order. The outputs from the output terminals C1-0 to C1-4 are coupled to the other input terminals of the AND gates A1-A5, respectively. On the counter C2, 12 count value output terminals C2-0, C2-1, . . . C2-11 are provided. From the output terminals C2-0 to C2-11 outputs having an interval of 5 seconds are sequentially delivered in its order. These outputs from the output terminals C2-0 to C2-11 are coupled to the other input terminals of the AND gates A11, A12, . . . A22, respectively.

A carry signal delivered for each one minute from the counter C2 is supplied to the input of a counter C3. The counter C3 is a scale of 5 counter having five count value output terminals C3-0, C3-1, . . . C3-4 and pulses having intervals of 1 minute are fed from the output terminals C3-0 to C3-4 to the other input terminals of the AND gates A6 to A10. A carry signal is delivered at 5-minute intervals from the counter C3 to the input terminal of a scale of 12 counter C4. The counter C4 has 12 counter value output terminals C4-0, C4-1, . . . C4-11. From these output terminals C4-0 to C4-11, outputs are sequentially delivered in its order for every five minute cycle and supplied to the other input terminals of the AND gates A31, A32, . . . A42. When 12 pulses are supplied at 5-minute intervals to the counter C4, a carry signal appears at a rate of one per hour from the counter C4 and it is delivered to a scale of 12 counter C5. The counter C5 has 12 count value output terminals C5-0, C5-1, . . . C5-11. From these output terminals C5-0 to C5-11, outputs are sequentially delivered at the rate of one per hour and each output is supplied to the other input terminal of the AND gates A51, A52, . . . A62.

Suppose, for example, that the time "55 minutes and 3 seconds past 1 o'clock" is indicated. An output is fed from the output terminal C5-1 of the counter C5 to one input terminal of the AND gate A52. A time division indication instruction signal $t3$ having an interval of 1m sec is supplied from the output terminal C6-3 of the counter C6 to the other input terminal of the AND gate A52. Consequently, a pulse signal is fed, at intervals of 1m sec, from the AND gate A52 through OR gate OR2 to an inverter I2. The pulse signal is inverted at the inverter I2 to a negative polarity and the inverted signal is fed through electrode plate E1 simultaneously to the cathodes of the diodes T1 and M5-M9. Since the time division indication instruction signal $t3$ is also supplied from the terminal C6-3 of the counter C6 to the anode of the diode T1, the hour indicating diode T1 is flashed in a cycle of 3m sec (i.e. lighted for 1m sec and extinguished for the remaining 2m sec) whereby the time "1 o'clock" is indicated. The flash of the diode T1 is seen as being continuously lighted, when viewed from the human eyes. An output appears also from the output terminal C4-11 of the counter C4 and it is delivered, together with the time division indication instruction output $t2$ of the counter C6, to the AND gate A42. Consequently, an output is fed at intervals of 1m sec from the AND gate A42 to the OR gate OR 12 and then to the inverter I12. A pulse signal with a negative polarity is intermittently supplied, at intervals of 1m sec, from inverter I12 through electrode plate E11 simultaneously to the diodes T11 and M55–M59. An output is supplied also from the output terminal C3-0 of the counter C3, together with the time division indication instruction signal $t2$, to the AND gate A6. A pulse signal is supplied, at a time interval corresponding to the signal $t2$, from the AND gate A6 through OR gate OR13 to the anode of the diode M55. Consequently, the minute indicating diode M55 is intermittently flashed at a time interval corresponding to the signal $t2$, whereby the time "55 minutes" is indicated.

An output is also fed from the output terminal C1-3 of the "second" counter C1, together with the time division indication instruction signal *t*1, to the input terminal of the AND gate A4 and an output is derived, according to the signal *t*1, from the OR gate OR16. An output from the terminal C2-0 of the counter C2 is supplied, together with the signal *t*1, to the AND gate A11 and an output is applied from the OR gate OR1 to the inverter I1. As a result, a pulse signal with a negative polarity is impressed, in accordance with the signal *t*1, from the inverter I1 through electrode plate E0 to the cathode of the diodes T0 and M0 to M4; whereby the diode M3 provides the second indication under the presence of the time division indication instruction signal *t*1. Since the count value of the counter C1 is varied for each one second and the count value of the counter C2 is varied at intervals of 5 seconds, the diodes M0 to M59 are sequentially flashed in its order to thereby provide the second indication. It is to be noted that in FIGS. 2A and 2B those diodes other than the selected diodes are reverse biased and extinguished.

Referring to FIGS. 1 and 2A and 2B, the cathodes of the 72 diodes T0-T11 and M0-M59 are grouped into 12 groups, each group being connected to the respective electrode plate (E0–E11) in a manner that the 6 cathodes in the respective group are connected in common to the corresponding electrode plate. The anodes of the 72 diodes are divided into six groups in a manner that the corresponding 12 diodes each derived from the respective 12-diode groups are commonly connected. As a result, only 18 circuit lines are necessary in making an electrical connection between the time indicating section as shown in a dotted line and the remaining time counting circuit section. This provides a greater advantage where the time counting device including time counters is embodied into an LSI form and the time indicating section is provided separately from the time counting device.

Though with the above-mentioned embodiment the cathodes of the diodes are connected in common to the respective electrode plate, the anodes of the diodes may be connected in common to the respective electrode plate, instead. In this case, an inverter is connected to respective cathode groups of the light emitting diodes instead of using inverters I1 to I12.

With the embodiment shown in FIG. 2, the light emitting diode is used as an optical time indicating element. However, even if use is made of a liquid crystal indicating element, the invention can be equally put into practice.

Figure 3:
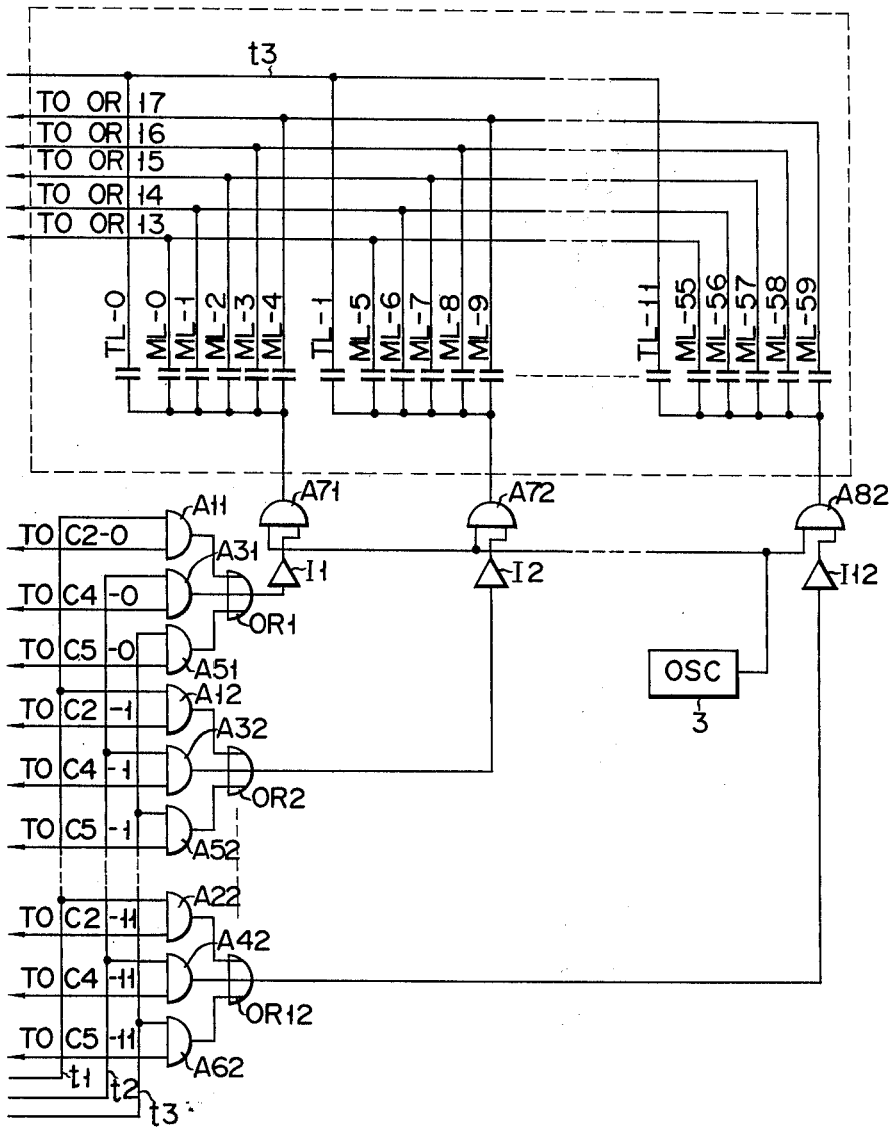
FIG. 3 is a schematic circuit diagram of another embodiment of this invention.

FIG. 3 indicates this embodiment in which the same reference numeral is used to denote parts or elements corresponding to those shown in FIG. 2B. It is to be noted that, since in the case of a liquid crystal a response to an input signal is slow, a counter C6 is required to be operated at a frequency of about 60 Hz. In the embodiment in FIG. 3 are provided liquid crystal hour indicating elements TL0 to TL11 corresponding to the hour indicating diodes T0 to T11 of FIG. 2B. One electrode of the liquid crystal hour indicating elements TL0 to TL11 is connected in common to the output terminal C6-3 of the counter C6, while the opposite electrode thereof is connected through respective electrode plate to the output terminal of AND gates A71 to A82. Sixty liquid crystal minute indicating elements ML0 to ML59 corresponding to the minute indicating diodes M0 to M59 of FIG. 2B are divided into 12 groups, each consisting of five elements. One electrode of the corresponding liquid crystal minute indicating elements each included in the respective 12 element groups is connected in common to the respective output terminal of the OR gates OR13 to OR17. The opposite electrodes of the 72 liquid crystal time indicating elements are divided into 12 groups, each group being connected through the respective electrode plate in common to the output terminal of the respective AND gates A71 to A82. One input terminal of the respective AND gates A71 to A82 is connected to the output terminal of the respective inverters I1 to I12, while the other input terminal of the AND gates A71 to A82 is connected in common to the output terminal of a high frequency oscillator 3. The high frequency oscillator 3 is adapted to obtain a signal with a frequency sufficient to forcefully stop the time indicating operation of the liquid crystal time indicating elements other than those liquid crystal time indicating elements now on display. For the so-called DSM type liquid crystal element, for example, it has an oscillation frequency of the order of about 4 to 5 KHz. Suppose, for example, that the time "55 minutes and 3 seconds past 1 o'clock" is indicated. An output is delivered from the AND gate A22 through OR gate OR12 to the inverter I12 and the AND gate A82 is caused to be closed by an output of negative polarity from the inverter I12. This prevents a high frequency pulse of the high frequency oscillator 3 from appearing at the output side of the AND gate A82. Consequently, the liquid crystal time indicating elements TL11 and ML55 to ML59 connected to the output of the AND gate A82 are set into a time representable state. A pulse signal is also applied from the AND gate A6 through OR gate OR13 to one electrode of the liquid crystal time indicating element ML55 whereby the element ML55 represents the time 55 minutes. Since, at this time, no input is applied to the inverters I1–I11, a gate signal is supplied from the inverters I1–I11 to the AND gates A71 to A81 and a high frequency signal is supplied from the oscillator 3 to one electrode of the liquid crystal time indicating elements TL-0 to TL-10 and ML-0 to ML-54 to thereby render these time indicating elements in a disabled state. The other operations are the same as in the above-mentioned embodiment and any further explanation is therefore omitted.

Though with the embodiments shown in FIGS. 1 to 3 use is made of 12 hour indicating elements and 60 minute indicating elements, time indication may be provided by varying the number of the respective hour and minute indicating elements. A time counting device is constructed by connecting together a plurality of scale of 5 and scale of 12 counters in a variety of combinations. However, a scale of 60 counter may be directly used instead. Between the time counter device and the AND gate of the time counting signal distribution circuit a decoder may be inserted as required. Though with the embodiment of FIGS. 2A and 2B the time indicating elements (T0 and M0 to M4), (T1 and M5 to M9) . . . are connected to the electrode plates E0, E1, . . . , respectively, for example, the time indicating elements (T0 and M55 to M59), (T1 and M0 to M4) . . . may be connected to the electrode plates E0, E1, . . . , respectively. This invention is likewise reduced to practice by connecting 2 hour indicating elements and 10 minute indicating elements to each of six electrode plates. That is, the output lines of the time counting device may be connected in a variety of ways so as to reduce the circuit lines to about 18 in number.

Figure 4:
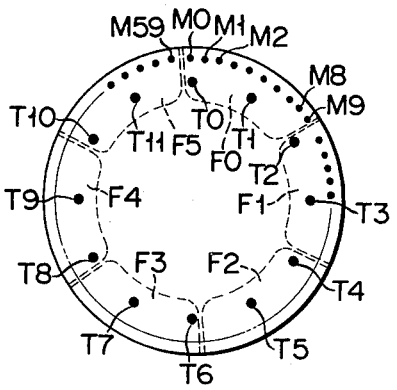
FIG. 4 is a plan view showing the time display section of a clock apparatus according to another embodiment of this invention.

Though in the embodiment shown in FIGS. 1 to 3 the respective hour indicating element is connected to one electrode of each of the 5 minute and second indicating elements, a pair of hour indicating elements in each of six electrode plates F0, F1, . . . F5 on the time display panel may be connected, as shown in FIG. 4, direct to one electrode of each of 10 minute and second indicating elements in corresponding electrode plate; the paired hour indicating elements T0 and T1 in the electrode plate F0 corresponding to the 10 minute and second indicating elements M0, . . . M9; the paired hour indicating elements T2 and T3 in the electrode plate F1, to the 10 minute and second indicating elements M10, . . . M19; . . . ; and the paired hour indicating elements T10 and T11 in the electrode plate F5, to the 10 minute and second indicating elements M50, . . . M59.

Figure 5:
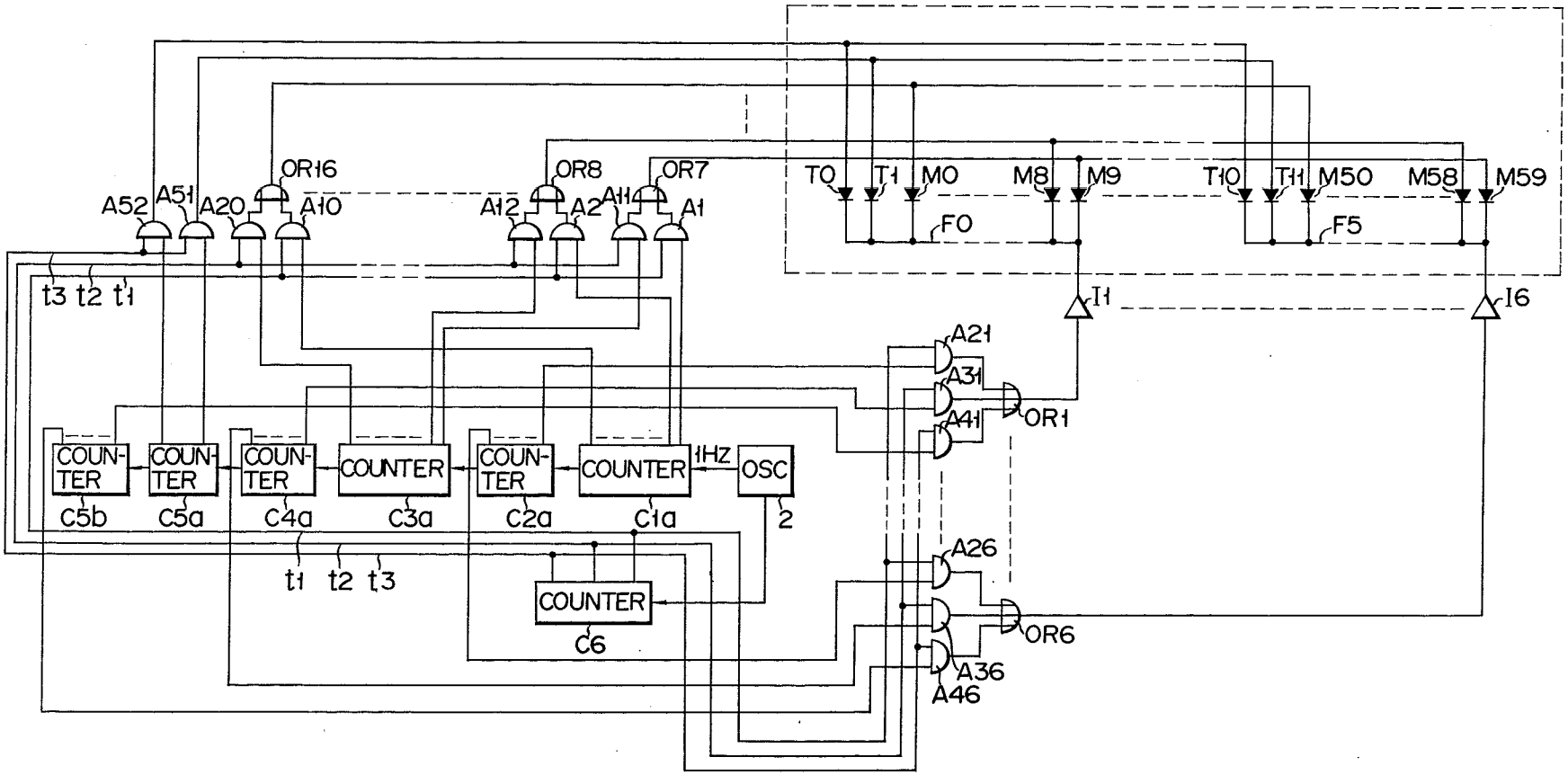
FIG. 5 is a schematic circuit diagram of the embodiment in FIG. 4.

FIG. 5 is a circuit arrangement showing the case where light emitting diodes are used as the hour indicating elements T0 to T11 and minute and second indicating elements M0 to M59 as shown in FIG. 4. In this Figure, similar reference numerals are employed to designate parts or elements corresponding to those shown in FIGS. 2A and 2B.

1Hz output pulses from the oscillator 2 are supplied to a decimal counter C1*a* and counter C6. The counter C6 generates outputs *t*1, *t*2 and *t*3 as in the case of the embodiment shown in FIGS. 2A and 2B and the counter C1*a* sequentially generates an output signal for each one second which is sequentially coupled to one input terminal of AND gates A1, A2, . . . A10 in this order. Since the output Al of the counter C6 is coupled to the other input terminal of each of the AND gates A1, A2, . . . A10, an output is sequentially generated for each one cycle from the AND gates A1, A2, . . . A10 in this order. The outputs of the AND gates A1, A2, . . . A10 are supplied respectively through OR gates OR7 . . . OR16 to the anode of the corresponding light emitting diodes, each consisting of the minute and second indicating element, which are included in the respective electrode plate. By way of example, the output of the OR gate OR7 is supplied to the corresponding elements M9, M19, M29, M39, M49 and M59 in the six electrode plates F0 . . . F5 each including 12 light emitting diodes. On the other hand, the decimal counter C1*a* generates a carry signal at 10-second intervals which is supplied to a scale of 6 counter C2*a*. Since the output of the scale of 6 counter C2*a* is sequentially supplied at 10-second intervals to one input terminal of AND gates A21 . . . A26 and the output signal *t*1 of the counter C6 is normally supplied to the other input terminal of each of the AND gates A21 . . . A26, the outputs of the AND gates A21 . . . A26 are sequentially applied at 10-second intervals to inverters I1 . . . I6, respectively through OR gates OR1 . . . OR6. For example, for a time period from 0 to 9 seconds a potential on only the output terminal of the inverter I1 is lowered by the output of the AND gate A21, and the light emitting diodes M0, M1, . . . M9 sequentially emit a light for each one second. In this way, a second display function is performed.

A minute display function will now be explained below.

As the counter C1*a* constitutes a decimal counter and the counter C2*a* a scale of 6 counter, the carry signal of the counter C2*a* is supplied at intervals of 1 minute to a decimal counter C3*a*. As a consequence, the output of the counter C3*a* is sequentially supplied for each 1 minute to one input terminal of AND gates A11 . . . A20 and, since the signal *t*2 is coupled to the other input terminal of each of the AND gates A11 . . . A20, an output is sequentially generated from the AND gates A11 . . . A20. The outputs of the AND gates A11 . . . A20 are coupled respectively through OR gates OR7 . . . OR16 to the corresponding indicating elements in the respective electrode plates. Since the carry signal of the counter C3*a* is supplied at intervals of 10 minutes to a scale of 6 counter C4*a*, the counter C4*a* generates an output at intervals of 10 minutes which is sequentially coupled to one input terminal of the AND gates A31 . . . A36 in its order. On the other hand, the signal *t*2 is also coupled to the other input terminal of the AND gates A31 . . . A36. The outputs of the AND gates A31 . . . A36 are sequentially delivered at intervals of 10 minutes to inverters I1 . . . I6 respectively through OR gates OR1 . . . OR6. As a result, the indicating elements M0 . . . M59 are sequentially energized at intervals of 10 minutes. In this way, a minute display is effected together with the second display.

The counter C4*a* generates a carry signal for each one hour which is supplied to a binary counter C5*a*. The outputs of the counter C5*a* are alternately coupled at intervals of one hour to one input terminal of AND gates A51 and A52. On the other hand, the gate signal *t*3 is normally supplied to the other input terminal of the AND gates A51 and A52. The AND gates A51 and A52 alternately generate an output signal for each one hour which is supplied to the corresponding indicating elements T1, T3, T5, T7, T9 and T11 in the respective electrode plates or to the corresponding indicating elements T0, T2, T4, T6, T8 and T10 in the respective electrode plates.

A carry signal of the binary counter C5*a* is supplied at the rate of one per 2-hour cycle to a scale of 6 counter C5*b*, and the output of the counter C5*b* is sequentially supplied at intervals of 2 hours to one input terminal of AND gates A41 . . . A46. As the gate signal *t*3 is applied to the other input terminal of each of the AND gates A41 . . . A46, the outputs of the AND gates A41 . . . A46 are sequentially supplied at intervals of 2 hours to the inverters I1 . . . I6 respectively through the OR gates OR1 . . . OR6. Suppose, for example, that "1 o'clock" is to be indicated. In this case, the outputs of the AND gates A51 and A41 are coupled to the light emitting diode T1 for hour indication to cause the latter to emit a light.

In the embodiment of FIG. 5, 18 lines are connected between the time counting circuit section and the time display section: i.e. 6 lines for the OR gates OR1 . . . OR6; 10 lines for the OR gates OR7 . . . OR16; and two lines for the AND gates A51 and A52. This embodiment is the same in the number of connection lines as the embodiment shown in FIGS. 2A and 2B. It is therefore easy to design the circuit shown in FIG. 5.

Figure 6:
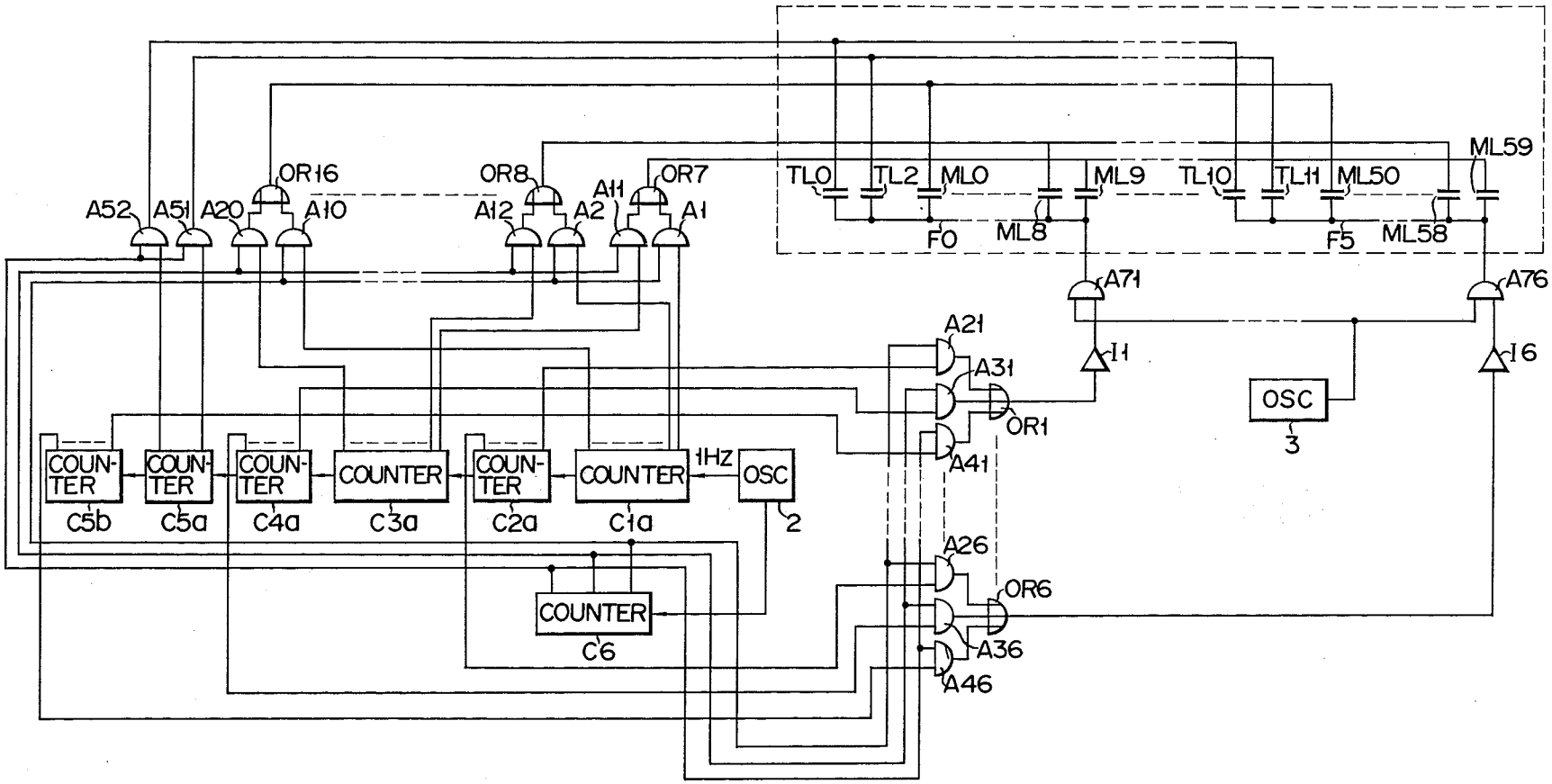
FIG. 6 is a schematic circuit diagram of a clock apparatus according to another embodiment of this invention.

FIG. 6 is a circuit arrangement showing the case where liquid crystal indicating elements are employed as indicating elements. The circuit arrangement of FIG. 6 is the same as that shown in FIG. 5, except that a high-frequency oscillator 3 and AND gates A71 . . . A76 are inserted, as in the case of FIG. 3, between an array of inverters I1 . . . I6 and a time display section. 12 liquid crystal elements TL0, TL1 . . . TL11 are used as the hour indicating elements and 60 liquid crystal elements ML0, ML1, . . . ML59 as the minute and second indicating elements. One electrode of each of the liquid crystal elements TL0, TL1, . . . TL11 and ML1 . . . ML59 are connected in six groups, each group consisting of 2 hour indicating elements and 10 minute and second indicating elements as in the case of FIG. 5, to the corresponding six electrode plates F0, F1, . . . F5 on a time display panel of an electronic clock apparatus. The high frequency oscillator 3 and AND gates A71 . . . A76 perform the same function as the embodiment in FIG. 3, and any further explanation is therefore omitted. Like the embodiment in FIG. 5, 18 connection lines are connected between the time counting circuit section and the time display section, thus making it easier to make wire connection during the assembly of the apparatus.

What is claimed is:

1. An electronic clock apparatus comprising:

a source of standard clock signals;

a time counting device counting said standard clock signals and generating hour, minute and second signals;

12 first indicating elements each of which has a pair of electrodes and which are divided into six groups, each group being constituted by two elements, and arranged in a closed loop so as to be responsive to an hour signal from the time counting device;

60 second indicating elements each of which has a pair of electrodes and which are divided into six groups each constituted by ten elements and arranged in a closed loop so as to indicate both minutes and seconds in response to a minute signal and a second signal from the time counting device;

six first connecting means connecting one of the electrodes of each first indicating element of each group to one of the electrodes of each second indicating element of the respective group, thus forming six units each consisting of two first indicating elements and 10 second indicating elements;

12 second connecting means each connecting the other electrodes of the first and second indicating elements of each unit to the corresponding other electrodes of the first and second indicating elements of the other units; and a time division control means coupled to the time counting device for selectively supplying in a time division fashion the hour, minute and second signals from the time counting device to the corresponding first and second indicating elements via the first and second connecting means.

2. An electronic clock apparatus according to claim 1 wherein said first and second indicating elements are light emitting diodes.

3. An electronic clock apparatus according to claim 1 wherein said first and second indicating elements are liquid crystal indicating elements.

* * * * *